US010760146B2

(12) United States Patent
Kido et al.

(10) Patent No.: US 10,760,146 B2
(45) Date of Patent: Sep. 1, 2020

(54) FASTENING COPPER ALLOY

(75) Inventors: Kouta Kido, Toyama (JP); Takuya Koizumi, Toyama (JP); Yasuharu Yoshimura, Toyama (JP); Takahiro Fukuyama, Toyama (JP); Atsushi Ogihara, Toyama (JP); Kouichi Mikado, Toyama (JP); Jun Kiyohara, Toyama (JP); Yoshio Taira, Toyama (JP)

(73) Assignee: YKK Corporation (JP)

( * ) Notice: Subject to any disclaimer, the term of this patent is extended or adjusted under 35 U.S.C. 154(b) by 207 days.

(21) Appl. No.: 14/419,499

(22) PCT Filed: Aug. 9, 2012

(86) PCT No.: PCT/JP2012/070364
§ 371 (c)(1),
(2), (4) Date: Feb. 4, 2015

(87) PCT Pub. No.: WO2014/024293
PCT Pub. Date: Feb. 13, 2014

(65) Prior Publication Data

US 2015/0218674 A1 Aug. 6, 2015

(51) Int. Cl.
*C22C 9/04* (2006.01)
*C22F 1/08* (2006.01)
(Continued)

(52) U.S. Cl.
CPC ..... *C22C 9/04* (2013.01); *A44B 19/00* (2013.01); *A44B 19/24* (2013.01); *C22F 1/08* (2013.01); *A44B 19/44* (2013.01)

(58) Field of Classification Search
CPC ..... A44B 19/00; A44B 19/24; A44B 19/44; C22C 9/04; C22F 1/08
See application file for complete search history.

(56) References Cited

U.S. PATENT DOCUMENTS 10,178,898 B2 * 1/2019 Koizumi ..... C22C 9/04
2009/0022620 A1 * 1/2009 Weber ..... C22C 9/04
420/471

(Continued)

FOREIGN PATENT DOCUMENTS

CN 1230230 A 9/1999
JP 2013-113454 A 4/2003

(Continued)

OTHER PUBLICATIONS

Yoshimura et al., JP 2003-113454, published Apr. 2003. (machine translation) (Year: 2003).*

(Continued)

*Primary Examiner* — John A Hevey
(74) *Attorney, Agent, or Firm* — Kilpatrick Townsend & Stockton LLP

(57) ABSTRACT

A copper alloy for fastening wherein the alloy has a structure of a mixture of α-phase and a β-phase; and wherein the alloy has a composition represented by the general formula: $Cu_{bal.}Zn_aMn_b$, where bal., a, and b are expressed in % by mass, bal. represents the balance, $34 \leq a \leq 40.5$, $0.1 \leq b \leq 6$, and inevitable impurities may be contained; and the composition satisfying the equation (1): $b \geq (-8a+300)/7$, where $34 \leq a < 37.5$ and equation (2): $b \leq (-5.5a+225.25)/5$, where $35.5 \leq a \leq 40.5$.

7 Claims, 3 Drawing Sheets

(51) Int. Cl.

| | |
|---|---|
| ***A44B 19/00*** | (2006.01) |
| ***A44B 19/24*** | (2006.01) |
| ***A44B 19/44*** | (2006.01) |

(56) References Cited

U.S. PATENT DOCUMENTS

| | | | | |
|---|---|---|---|---|
| 2010/0297464 | A1* | 11/2010 | Oishi | B23K 35/302 428/586 |
| 2013/0333165 | A1* | 12/2013 | Prest | B21J 1/006 24/381 |
| 2014/0294665 | A1* | 10/2014 | Torre | C22C 9/04 420/582 |
| 2018/0049521 | A1* | 2/2018 | Koizumi | C22C 9/04 |

FOREIGN PATENT DOCUMENTS

| | | | |
|---|---|---|---|
| JP | 2004-332014 | A | 11/2004 |
| JP | 2004332014 | A * | 11/2004 |
| JP | 4357869 | B2 | 11/2009 |

OTHER PUBLICATIONS

International Search Report, PCT Application No. PCT/JP2012/070364, dated Sep. 18, 2012.

European Search Report, European Patent Application No. 12882822.5, dated Jun. 17, 2016.

Dutkiewicz et al., "Influence of Manganese Content on Superplastic Deformation of .Alpha.+.Beta. Brasses", Archivum Nauki O Materialach, Panstwowe Wydawnictwo Naukowe, Warsaw, Poland, vol. 27, Nos. 2-3, Dec. 31, 2006, pp. 101-110.

Kurbatkin et al., "Evolution of the Structure of Multicomponent Manganese Brass and its Relation to the Appearance of Defective Products", Izvestiya Vysshikh Uchebnykh Zavedenii, Seriya Chernayametallurgiya, Moskovskii Gosudarstvennyi Institut Stali I Splavov, No. 5, Dec. 31, 2002, pp. 58-62.

Zhao et al., "Localized Corrosion of Copper Alloys in China Seawater for 16 years", Transactions of NonFerrous Metals Society of China, Nonferrous Metals Society of China, China, vol. 14, No. 6, Dec. 31, 2004, pp. 1082-1090.

Japan Copper and Brass Association, Foundation of Copper and Copper Alloys and Industrial Technology (revised edition) editing committee, "Foundations of Copper and Copper Alloys and Industrial Technology", revised version 2nd edition, May 22, 2010, pp. 577-579.

Japan Copper and Brass Association, Copper-Copper product data book editing committee, 2nd edition, Mar. 31, 2009, p. 104.

Office Action, Taiwanese Patent Application No. 102126729, dated Oct. 16, 2014.

* cited by examiner

FASTENING COPPER ALLOY

This application is a national stage application of PCT/JP2012/070364, which is incorporated herein by reference.

TECHNICAL FIELD

The present invention relates to a copper alloy for fastening used as fastening material.

BACKGROUND ART

Cu—Zn-based alloys are excellent in workability and have been widely used in various fields. With regard to Cu—Zn-based alloys, zinc base metal is generally more inexpensive than copper base metal. Therefore, material cost thereof can be reduced by increasing a zinc content. There exists a problem, however, that zinc element present in copper results in significant deterioration in corrosion resistance. In particular, when a copper alloy having an increased zinc content is used for a fastening material which is embedded on a base fabric through cold working, there has occurred a problem of season cracking of the material due to residual work strain.

Japanese Patent No. 4357869 discloses a technique in which an alloy contains elemental additives, such as Al, Si, Sn and/or Mn, and is surface-treated by means of shot-blasting or the like to be provided with compression stress in order to enhance season cracking resistance.

CITATION LIST

Patent Literature

[Patent Literature 1] Japanese Patent No. 4357869

SUMMARY OF INVENTION

However, the copper alloy described in Patent Literature 1 requires to be subjected to processing such as shot-blasting, thereby increasing numbers of the manufacturing processes, and this causes an increased manufacturing cost. In addition, according to Patent Literature 1, the structure of the copper alloy is made into a single phase of α in order to obtain suitable cold-workability and an increased zinc concentration in the alloy is undesirable because of causing significant formation of β-phase, which makes cold working of the alloy difficult. Therefore, in the technique described in Patent Literature 1, season cracking resistance and cold workability of the alloy have not yet been sufficiently studied when the zinc concentration in the alloy is increased to allow the α and β phases coexist. In addition, the copper alloy described in Patent Literature 1 has a problem that the zinc concentration is too low to be manufactured by extrusion.

In view of the problems described above, the present invention provides a copper alloy for fastening excellent in ease of manufacturing and also excellent in season cracking resistance and cold-workability.

According to an aspect of the present invention, in order to solve the problems described above, a copper alloy for fastening is provided, wherein the alloy has a structure of a mixture of α-phase and a β-phase; and wherein the alloy has a composition represented by the general formula: $Cu_{bal.}Zn_aMn_b$, where bal., a, and b are expressed in % by mass, bal. represents the balance, 34≤a≤40.5, 0.1≤b≤6, and inevitable impurities may be contained; and the composition satisfying the following equations (1) and (2):

$$b \geq (-8a+300)/7, \text{ where } 34 \leq a < 37.5 \quad (1),$$

$$b \leq (-5.5a+225.25)/5, \text{ where } 35.5 \leq a \leq 40.5 \quad (2).$$

In one embodiment, a copper alloy for fastening according to the present invention is a copper alloy for fastening wherein the alloy has a structure of a mixture of α-phase and a β-phase; and wherein the alloy has a composition represented by the general formula: $Cu_{bal.}Zn_aMn_b$, where bal., a, and b are expressed in % by mass, bal. represents the balance, 35≤a≤38.3, 0.2≤b≤3.5, and inevitable impurities may be contained; and the composition satisfying the following equations (3) and (4):

$$b \geq -a+38.5, \text{ where } 35 \leq a \leq 38.3 \quad (3),$$

$$b \leq -a+40.5, \text{ where } 37 \leq a \leq 38.3 \quad (4).$$

In another embodiment of the copper alloy for fastening according to the present invention, the β-phase percentage (%) in the structure is 0.1≤β≤22 as determined from the result of observation of a cross section perpendicular to the rolled surface using an integrated peak intensity ratio in X-ray diffraction.

In still another embodiment of the copper alloy for fastening according to the present invention, the mean crystal grain size in the structure is 3-14 μm.

In yet another embodiment of the copper alloy for fastening according to the present invention, the pull-out strength after ammonia vapor test is 70% or more relative to that of $Cu_{85}Zn_{15}$ material.

According to another aspect of the present invention, a component article for fastening formed of the above-described copper alloy for fastening is provided.

According to the present invention, it is possible to provide a copper alloy for fastening excellent in ease of manufacturing and also excellent in season cracking resistance and cold-workability.

Figure 1:
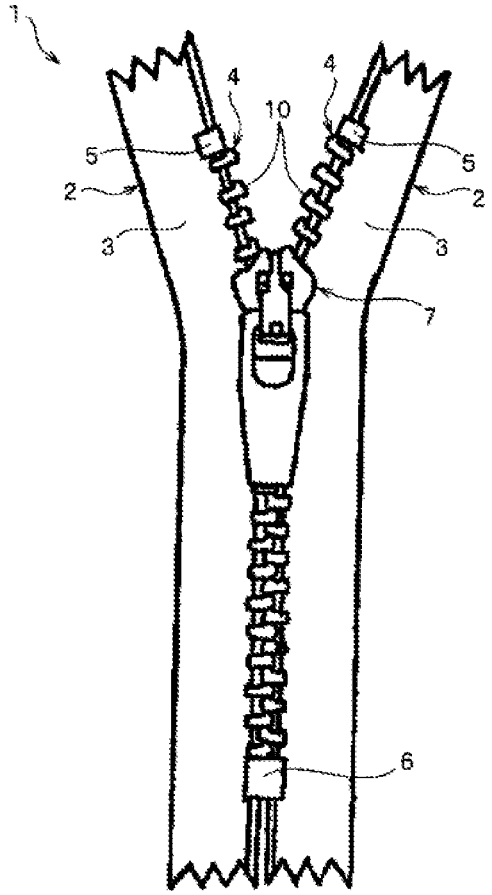
FIG. 1 is a plane view showing an example of a slide fastener using a copper alloy for fastening according to an embodiment of the present invention.

DETAILED DESCRIPTION OF THE EMBODIMENTS (Copper Alloy for Fastening)

A copper alloy for fastening according to an embodiment of the present invention is a copper alloy of which structure consists of a mixed phase of an α-phase having a face centered cubic structure and a β-phase having a body centered cubic structure. Although season cracking sensitivity is generally known to be higher as the amount of Zn is increased, according to the intensive studies by the present inventors, it has been found that cold-workability of 80% or more can be realized and the season cracking resistance can be also enhanced by adjusting the concentrations of zinc and elemental additives in copper in suitable ranges and controlling the heating conditions and cooling conditions upon manufacturing, thereby controlling the structure such that the structure becomes a suitable α+β phase.

<Zn>

When the zinc content is less than 34% by mass, the consequently increased copper content leads to a higher material cost and, for a copper-zinc-manganese ternary alloy, the manganese content is increased, thereby causing a problem that the alloy cannot be a material capable of avoiding needle detection due to the increased manganese content. The term "material capable of avoiding needle detection" as used herein refers to a material corresponding to a product that can satisfy the NC-B standard (ϕ1.2 mm or less in terms of steel ball). When the zinc content exceeds 40.5%, the structure in the cast material has a β-phase percentage of 50% or more and this makes the material brittle, thereby deteriorating the cold-workability of the copper alloy and easily causing brittle fracture. The Zn content in the copper alloy is preferably 34-40.5% by mass, more preferably 35-38.3% by mass, and still more preferably 35-38% by mass.

<Mn>

Although Cu—Zn-based alloys have a problem that zinc element present in copper in a high concentration causes significant deterioration in corrosion resistance, addition of Mn to copper as an additional element can effectively inhibit the season cracking of the fastening materials. The addition of Mn also leads to an effect to easily make the crystal grains finer, thereby enhancing the strength.

It is noted that Al, Si, Sn and the like are also generally known as elemental additives which are added for the purpose of improving characteristics of copper alloys. These elemental additives, however, have large values of zinc equivalent, and thus addition thereof even in a very small amount may significantly change properties of the alloy in some cases. This makes it difficult to constantly control the quality of the copper alloy for fastening which is intended to be manufactured in mass production, thereby the ease of its manufacture cannot be improved. On the contrary, Mn has a zinc equivalent of 0.5 which is much smaller than those of other elemental additives such as Al, Si, and Sn. Therefore, comparing with other elemental additives, Mn can make a smaller quality difference of final products which may occur due to manufacturing errors, and thus provide a copper alloy for fastening excellent in quality stability and suitable for mass production.

With regard to the copper alloy according to the present invention, it is possible to obtain a copper alloy for fastening exhibiting both of cold-workability of 80% or more and season cracking resistance by adding Mn in an amount of 0.1% by mass or more. An excessively large Mn content results in deterioration in cold-workability. In addition, magnetization of the alloy per se may make the operation of needle detection required for the manufactured fastening material difficult. Preferably, the amount of Mn added is 0.1-6% by mass in order to prevent a high material cost due to a reduced amount of zinc, more preferably 0.1-3.5% by mass, and still more preferably 0.2-3.0% by mass in order to satisfy the NC-A standard of needle detection (0.8 mmϕ or less in terms of a steel ball).

<Relationship Between Respective Compositions>

Preferably, the copper alloy for fastening according to the embodiment of the present invention has a composition represented by the general formula: $Cu_{bal.}Zn_aMn_b$, where bal., a, and b are expressed in % by mass, bal. represents the balance, $34 \le a \le 40.5$, $0.1 \le b \le 6$, and inevitable impurities may be contained, and the composition satisfying the following equations (1) and (2):

$$b \ge (-8a+300)/7, \text{ where } 34 \le a < 37.5 \quad (1),$$

$$b \le (-5.5a+225.25)/5, \text{ where } 35.5 \le a \le 40.5 \quad (2).$$

The reason why the relationship between respective compositions is determined as represented by equations (1) and (2) is that it is difficult to realize both of cold-workability and season cracking resistance necessary for the fastening material in the case of not satisfying equations (1) and (2). More specifically, when the concentration of Mn does not satisfy equation (1), i.e., $b<(-8a+300)/7$, the copper alloy can be worked more easily, but may be cracked more often upon exposure to a corrosive environment such as ammonia. On the other hand, when the concentration of Mn does not satisfy equation (2), i.e., $b>(-5.5a+225.25)/5$, the structure becomes brittle and cold-workability is deteriorated though less cracking occurs.

More preferably, the copper alloy for fastening according to the embodiment of the present invention is a copper alloy further satisfying equations (3) and (4) below:

$$b \ge -a+38.5, \text{ where } 35 \le a \le 38.3 \quad (3),$$

$$b \le -a+40.5, \text{ where } 37 \le a \le 38.3 \quad (4).$$

When the copper alloy has a composition satisfying equations (3) and (4), the color tone in appearance of the finally obtained copper alloy very closely approaches to that of existing $Cu_{85}Zn_{15}$ alloy which the customers desire. Therefore, even when fastening materials are manufactured in mass production using the copper alloy according to the present invention, color tone changes to a lesser degree among the fastening materials. Further, the β-phase is easily controlled to a desired ratio, thereby successfully providing fastening materials at a high yield and excellent in quality stability and appearance. In addition, the copper alloy is a more useful material as a fastening material capable of avoiding needle detection.

<Percentage of α-Phase and β-Phase>

Control of the percentage of α-phase and β-phase in the copper alloy is important in order to improve season cracking resistance and cold-workability required for the fastening materials. Control of the percentage of α-phase and β-phase can be attained by adjusting the heating conditions and subsequent cooling conditions.

According to the copper alloy according to the embodiment of the present invention, preferably the β-phase percentage (%) in the crystalline structure is $0.1 \le \beta \le 22$, and more preferably $0.5 \le \beta \le 20.5$. The reason for that is when the β-phase percentage is excessively high, the cold-workability cannot be ensured and when the β-phase percentage is excessively low, sufficient season cracking resistance cannot be obtained in spite of containing manganese. It is noted that the "β-phase percentage in the crystalline structure" refers to a value as calculated by:

β-Phase percentage (%)=(Integrated β-phase peak intensity value)/(Integrated α-phase peak intensity value+Integrated β-phase peak intensity value)×100, where the integrated peak intensity values of the α-phase and the β-phase are calculated by performing polishing with SiC water-proof polishing paper and performing mirror-finishing with diamond to expose a cross section perpendicular to the rolled surface, and analyzing the cross section by X-ray diffraction (θ−2θ method).

<Crystal Grain Size>

With regard to the copper alloy according to the embodiment of the present invention, preferably the mean crystal grain size in the structure is 14 μm or less, and, for example, 3-13.5 μm. The mean crystal grain size is not particularly limited for the lowest value, but is preferably 0.1 μm or more in order for homogeneous recrystallization. In the present embodiment, the term "mean crystal grain size" refers to a value of length of the mean crystal grain size determined by drawing 20 lines at random or arbitrarily on an metal structure observation photograph obtained by observation using an electron microscope or an optical microscope from the edge to edge of the observation photograph, measuring the length of these lines and correcting the length by comparing with the actual scale, and dividing the corrected length of the lines by a number of the grain boundaries crossing the lines. That is, the mean crystal grain size is evaluated by: (Mean crystal grain size)=(Total length of the lines drawn on the photograph corrected to the actual length (length of 20 lines)/(number of grain boundaries crossing the lines drawn on the photograph).

<Properties>

The copper alloy for fastening according to the embodiment of the present invention can exhibit a pull-out strength after ammonia vapor test of 70% or more relative to that of $Cu_{85}Zn_{15}$ material, and for this alloy, the cold-workability can be 80% or more, and the extrusion surface pressure at 500° C. can be 1100 MPa or less, which corresponds to 65% or less as a percentage to that of $Cu_{85}Zn_{15}$ material. It is meant by this value of the extrusion surface pressure at 500° C. that the lifetime of the die can be prolonged because the yield strength at 500° C. of a typical steel material for the die is approximately 1400 MPa. In addition, the copper alloy for fastening according to the embodiment of the present invention is not only effective in cold working processes but also is sufficiently usable in hot working processes. Accordingly, it is possible to provide a material from which even a fastener of No. 5 size (a size in which the element width is 5.5 mm or more and less than 7.0 mm in a state where a pair of the fastener elements engage with each other) with high strength can be manufactured, of which season cracking resistance and stress corrosion resistance can be improved, and which is easily worked and suitable for mass production. It is noted that the details of the evaluation methods for ammonia vapor test, the cold-workability and the extrusion surface pressure at 500° C. will be described in Examples below.

<Component Articles for Fastening>

Examples of component articles for fastening suitable for the copper alloy for fastening according to the present invention are described, referring to the drawings. It is noted although the description takes parts composing a slide fastener as examples for the component articles for fastening in the following embodiment, the present invention can be similarly applied for products formed of a copper alloy other than the fastening materials described below or intermediate products prior to obtaining the final products (e.g., long wire rods described below).

Though the copper alloy for fastening according to the present invention can be utilized for component articles for fastening, such as a fastener element, an top end stop, a bottom end stop, a retaining box and a slider, the copper alloy can be also utilized for a variety of fastening materials other than the parts exemplified herein, as a matter of course. Here, explanations are made, taking an example of a slide fastener 1.

The slide fastener 1 includes, for example as shown in FIG. 1, a pair of right and left fastener stringers 2 on which element rows 4 are formed by attaching a plurality of fastener elements 10 in rows on the side edges of fastener tapes 3 opposing to each other, top end stops 5 and bottom end stop 6 attached at the top end parts and the bottom end parts of the right and left fastener stringers 2 along with the element rows 4, respectively, and a slider 7 slidably arranged along with the element rows 4.

Figure 2:
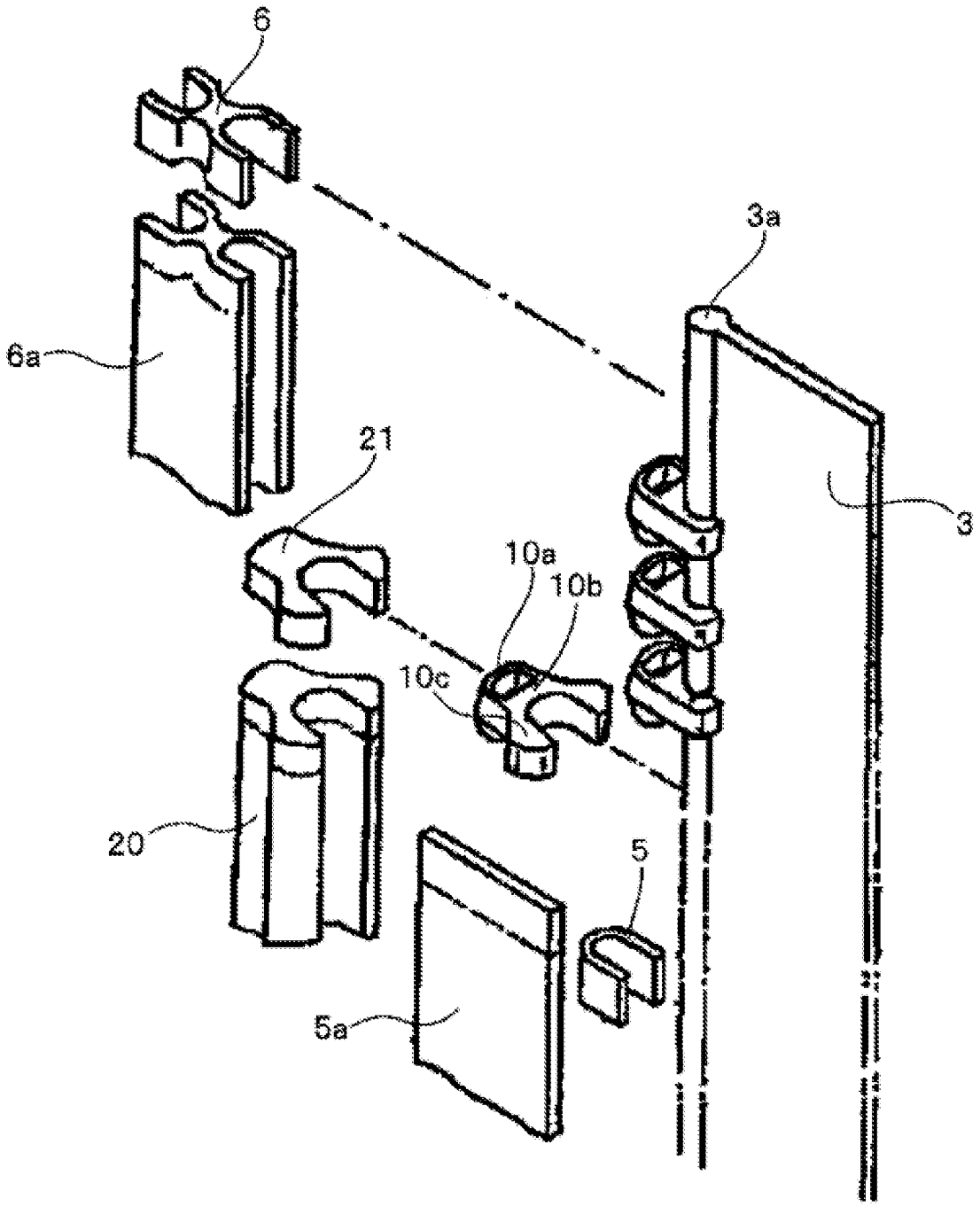
FIG. 2 is a perspective view illustrating attachment of fastener elements and top end and bottom end stops using a copper alloy for fastening according to an embodiment of the present invention to a fastener tape.

Each fastener element 10 is manufactured by, as shown in FIG. 2, slicing a wire rod 20 having a generally Y-shaped cross section, referred to as Y-bar, at a predetermined thickness, and subjecting the sliced element material 21 to press working or the like to form an engaging head 10*a*.

The fastener element 10 includes the engaging head 10*a* formed by press working or the like, a body part 10*b* extended in one direction from the engaging head 10*a*, and a pair of leg parts 10*c* bifurcated and extended from the body part 10*b*. The fastener elements 10 are attached to the fastener tape 3 at predetermined intervals by caulking the leg parts 10*c* in a direction in which both of the leg parts 10*c* approach to each other (inward) to plastically deform the leg parts 10*c* in a state where the element-attaching part of the fastener tape 3 including a core string part 3*a* has been inserted between a pair of the leg parts 10*c*.

The top end stop 5 for the slide fastener 1 is manufactured by slicing a flat rectangle 5*a* having a rectangular-shaped cross section at a predetermined thickness and bending the obtained cut piece to form an article having a generally U-shaped cross section. In addition, the top end stop 5 is attached to each of the right and left fastener tapes 3 by caulking the top end stop 5 to plastically deform the top end stop 5 in a state where the element-attaching part of the fastener tape 3 has been inserted into the space at the inner surface side of the top end stop 5.

The bottom end stop 6 for the slide fastener 1 is manufactured by slicing a deformed wire rod 6*a* having a generally H-shaped (or generally X-shaped) cross section at a predetermined thickness. In addition, the bottom end stop 6 is attached to the right and left fastener tapes 3 straddling the both tapes by caulking the bottom end stop 6 to plastically deform the bottom end stop 6 in a state where the element-attaching parts of the right and left fastener tapes 3 have been inserted into the spaces at the inner surface side of the right and left parts of the bottom end stop 6, respectively.

The fastening materials, such as fastener element 10, the top end stop 5, the bottom end stop 6 and the slider 7, are often subjected to cold-working and have tensile residual stress caused by this cold-working, and therefore season cracking has often happened for the alloys containing a large amount of zinc. According to the copper alloy according to the embodiment of the present invention, the alloy can be that can realize cold-workability of 80% or more and is excellent in season cracking resistance by adjusting the concentrations of zinc and the elemental additives in copper in suitable ranges and controlling the heating conditions and cooling conditions upon manufacturing, thereby controlling the structure such that the structure becomes a suitable $\alpha+\beta$ phase.

<Manufacturing Method>

Examples of methods for manufacturing a component article for fastening using the copper alloy for fastening are described.

When the fastener element 10 shown in FIG. 1 is manufactured, first a copper-zinc alloy casting material having a predetermined cross-sectional area is manufactured. Upon casting, the casting material is cast, while adjusting the copper-zinc alloy composition such that the zinc content is preferably 34-40.5% by mass, more preferably 35-38.3% by mass, and still more preferably 35-38% by mass.

Subsequently, after manufacturing the casting material, the percentage of the α-phase and the β-phase in the copper-zinc alloy is controlled such that the β-phase percentage is $0.1 \leq \beta \leq 22$, more preferably $0.5 \leq \beta \leq 20.5$ by subjecting the casting material to cold wire drawing into a wire rod having a desired wire diameter and to heat treatment. The conditions of the heat treatment to which the casting material is subjected can be arbitrarily set depending on the composition of the copper-zinc alloy.

After controlling the β-phase percentage in the casting material, a long wire rod, which is an intermediate product, is manufactured by subjecting the cast material to cold working such as cold extrusion such that the working reduction percentage is, for example, 80% or more. The cold working is carried out at a temperature below the recrystallization temperature of the copper-zinc alloy, and it is preferred to carry out the cold working at a temperature of 200° C. or below, and particularly at a temperature of 100° C. or below.

Subsequently, the above-described Y-bar 20 is formed by passing the cold-worked long wire rod through a plurality of rolling rolls to perform cold working such that the cross section of the wire rod becomes a generally Y-shape. The fastener element 10 according to the present embodiment can be manufactured by slicing Y-bar 20 at a predetermined thickness and subjecting the sliced element material 21 to press work using a forming punch and a forming die or the like to form the engaging head 10*a*. It is noted that deformed wire rods such as the Y-bar can be also directly manufactured by directly extruding the casting material at 400° C. or above since the copper alloy according to the present invention is also excellent in hot-extrudability.

In the case of the top end stop 5, first a casting material made of a copper-zinc alloy having the similar composition to that of the fastener element 10 is cast, and then the casting material is subjected to heat treatment to control the β-phase percentage in the copper-zinc alloy. Subsequently, the obtained casting material is subjected to cold working to manufacture a flat rectangle 5*a* (intermediate product) having a rectangular-shaped cross section. Then the top end stop 5 can be manufactured by slicing the obtained flat rectangle 5*a* at a predetermined thickness as shown in FIG. 2 and bending the obtained cut piece to form an article having a generally U-shaped cross section.

In the case of the bottom end stop 6, first a casting material made of a copper-zinc alloy having a similar composition to that of the fastener element 10 and the top end stop 5 is cast, and then the casting material is subjected to heat treatment to control the β-phase percentage in the copper-zinc alloy. Subsequently, the obtained casting material is subjected to cold working to manufacture a deformed wire rod 6*a* (intermediate product) having a generally H-shaped (or generally X-shaped) cross section. Then the bottom end stop 6 can be manufactured by slicing the obtained deformed wire rod 6*a* at a predetermined thickness as shown in FIG. 2.

EXAMPLES

Hereinafter, Examples together with Comparative Examples of the present invention will be presented and these Examples are provided in order for a better understanding of the present invention and advantages thereof, and it is not intended that the present invention is limited to the Examples.

Copper, zinc, and various elemental additives were weighed so as to make the alloy compositions as shown in Table 1 below, these ingredients were melted under an argon atmosphere using a high frequency vacuum melting apparatus to manufacture an ingot having a diameter of 40 mm, and then an extruded material having a diameter of 8 mm was manufactured from the obtained ingot. The obtained extruded material was subjected to cold working until the material became a predetermined plate having a plate thickness ranging 4.0-4.2 mm.

The plate material was subjected to heat treatment at a temperature in the range of 400° C. or above to 700° C. or below and then the heat-treated plate material was annealed. The plate material in which work strain was removed by the heat treatment was subjected to cold rolling where the plate material was rolled only from the vertical directions to manufacture a long plate material having a thickness of 1 mm or less. Test pieces with a plate thickness of 0.8 mm, a plate width of 10 mm, and a plate length of predetermined value (length in the rolling direction) were cut from the resulting plate material.

<Evaluation of β Percentage>

For each resulting test piece, the structure of the copper-zinc alloy on a cross section perpendicular to the rolled surface was observed with a cross sectional photograph. The cross section perpendicular to the rolled surface was exposed by polishing with SiC water-proof polishing paper (#180-#2000), was further mirror-finished with diamond paste 3 μm, 1 μm, and then X-ray diffraction measurement was carried out using the polished cross section as a test piece. GADDS-Discover 8 (Bruker AXS K.K.) was used as a measuring apparatus for a measuring time of 90 sec. for the lower angle side and 120 sec. for the higher angle side and the integrated peak intensity ratios of the α-phase and β-phase were calculated, respectively. The β-phase percentage was calculated as follows:

β-phase percentage (%)=(Integrated β-phase peak intensity value)/(Integrated α-phase peak intensity value+Integrated β-phase peak intensity value)×100.

<Evaluation of Cold Workability>

The plate material having a plate thickness of 4.0-4.2 mm obtained by the above-described process was subjected to air annealing at 500° C. for 6 hours, and then the plate-like test pieces were subjected to milling in order to remove an oxide film formed on the surface, and to finishing the surface with SiC water-proof polishing paper (#800) to manufacture the test pieces for cold workability evaluation. The finished dimensions of the test piece for cold-workability evaluation were a plate thickness of 3.5 mm, a plate width of 7.5 mm, and a plate length of a predetermined value. The draft limit based on the following equation was evaluated using a rolling mill. The draft limit was defined as a draft at the pass just before the pass where cracking occurred on the material.

(Draft) (%)=[(Plate thickness at start of rolling−Plate thickness after rolling)/(Plate thickness at start of rolling)]×100

<Extrusion Pressure at 500° C.>

Figure 3:
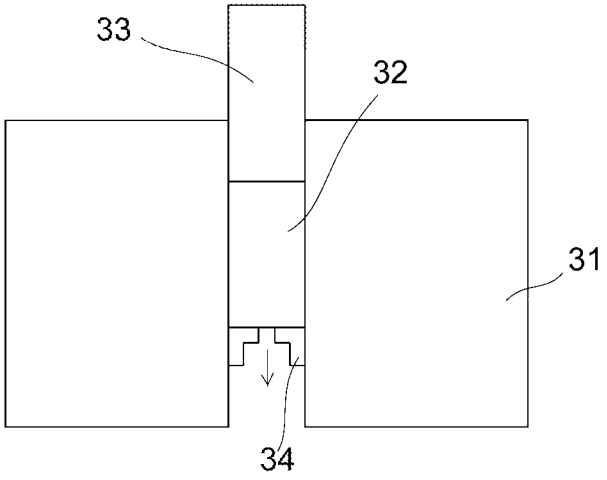
FIG. 3 is a cross sectional view showing an extrusion part of an extrusion container used to measure an extrusion surface pressure at 500° C. for a copper alloy.

Copper, zinc, and various elemental additives were weighed so as to make the alloy compositions as shown in Table 1, these ingredients were melted under an argon atmosphere using a high frequency vacuum melting apparatus to manufacture an ingot (a billet) having a diameter of 40 mm. An extruder container 31 shown in FIG. 3 was set at 500° C. and the billet 32 was heated in an atmospheric furnace set at 800° C. for 30 minutes, and then the billet 32 was inserted into the extruder container (inner diameter 42 mmϕ). A stem 33 was arranged on the billet 32, the billet 32 was pressed by the stem 33 to be extruded through a die 34 for a 8 mmϕ material arranged on the front face of the extruder container 31, the maximum load during the extrusion was measured, the maximum surface pressure was calculated from the maximum load, and "Extrusion surface pressure at 500° C." was defined as this maximum surface pressure.

<Evaluation of Mean Pull-Out Strength after Exposure to Ammonia>

The exposure test to ammonia was carried out according to Japan Copper and Brass Association Technical Standard JBMA-T301, Ammonia test method of copper alloy wrought material (JBMA method). It is noted that fastener chains of No. 5 were exposed to ammonia atmosphere, washed and then used as test pieces for evaluation of the fastener product. The resulting elements of the fastener chains as the test pieces were stretched by a tensile testing machine, and the obtained mean value of the load was defined as the mean pull-out strength. The results are shown in Table 1. It is noted that, in Table 1, "Excellent" refers to the case where the mean pull-out strength is 85% or more, "Good" refers to the case where the mean pull-out strength is 70% or more and less than 85%, "Fair" refers to the case where the mean pull-out strength is 55% or more and less than 70%, and "Poor" refers to the case where the mean pull-out strength is less than 55%, based on the pull-out strength for $Cu_{85}Zn_{15}$ material (Comparative Example 1).

<Needle Detection Standard>

Needle detection performance was evaluated using the test pieces used in <Evaluation of mean pull-out strength after exposure to ammonia> described above. The case where the needle detection value of the test piece was 0.8 mmϕ or less in terms of a steel ball was evaluated as NC-A standard, and the case where the needle detection value was 1.2 mmϕ or less in terms of a steel ball was evaluated as NC-B standard.

TABLE 1

| | Alloy composition (wt %) | | | | | | β Percentage | Cold | Extrusion pressure at 500° C. | Mean pull-out strength after exposure to | Mean crystal grain size of evaluated | Needle detection |
|---|---|---|---|---|---|---|---|---|---|---|---|---|
| | Cu | Zn | Mn | Al | Si | Sn | (%) | workability | (MPa) | ammonia | material (μm) | standard |
| Example 1 | 60.2 | 37.6 | 2.2 | 0 | 0 | 0 | 14 | Pass at 80% or more | 935 | Good | 3.7 | NC-A |
| Example 2 | 59.6 | 34.8 | 5.6 | 0 | 0 | 0 | 13 | Pass at 80% or more | 854 | Good | 3.9 | NC-B |
| Example 3 | 61 | 38.1 | 0.9 | 0 | 0 | 0 | 5.6 | Pass at 80% or more | 995 | Excellent | 10.8 | NC-A |
| Example 4 | 59.9 | 39.2 | 0.9 | 0 | 0 | 0 | 17.5 | Pass at 80% or more | 898 | Excellent | 8.7 | NC-A |
| Example 5 | 61 | 38.6 | 0.4 | 0 | 0 | 0 | 7.2 | Pass at 80% or more | 963 | Excellent | 12.8 | NC-A |
| Example 6 | 60 | 39.6 | 0.4 | 0 | 0 | 0 | 19.3 | Pass at 80% or more | 882 | Excellent | 8.2 | NC-A |
| Example 7 | 59.8 | 40 | 0.2 | 0 | 0 | 0 | 20.4 | Pass at 80% or more | 910 | Excellent | 7.7 | NC-A |
| Example 8 | 61.4 | 35.8 | 2.8 | 0 | 0 | 0 | 0.8 | Pass at 80% or more | 1053 | Good | 13.2 | NC-A |
| Example 9 | 60.4 | 35.8 | 3.8 | 0 | 0 | 0 | 7 | Pass at 80% or more | 1016 | Good | 10.5 | NC-A |
| Comparative Example 1 | 85 | 15 | 0 | 0 | 0 | 0 | 0 | Pass at 80% or more | 1800 or more | Excellent | n.d. | NC-A |
| Comparative Example 2 | 65 | 35 | 0 | 0 | 0 | 0 | 0 | Pass at 80% or more | 1191 | Poor | 15.7 | NC-A |
| Comparative Example 3 | 60.6 | 39.4 | 0 | 0 | 0 | 0 | 14 | Pass at 80% or more | 924 | Poor | 7.9 | NC-A |
| Comparative Example 4 | 59.5 | 40.5 | 0 | 0 | 0 | 0 | 23 | Pass at 80% or more | 877 | Fair | 9.0 | NC-A |
| Comparative Example 5 | 59.2 | 40.8 | 0 | 0 | 0 | 0 | 29 | Pass at 80% or more | 812 | Fair | 11.3 | NC-A |
| Comparative Example 6 | 60.6 | 39.4 | 0 | 0 | 0 | 0 | 39 | Pass at 80% or more | 924 | Fair | 7.4 | NC-A |
| Comparative Example 7 | 61.2 | 38.8 | 0 | 0 | 0 | 0 | 40 | 39% | 1063 | Poor | Not evaluable | Not evaluable |
| Comparative Example 8 | 58 | 42 | 0 | 0 | 0 | 0 | 45 | 39% | 689 | Poor | Not evaluable | Not evaluable |
| Comparative Example 9 | 65.5 | 34 | 0.5 | 0 | 0 | 0 | 0 | Pass at 80% or more | 1250 | Poor | 14.2 | NC-A |
| Comparative Example 10 | 63.6 | 34.3 | 2.1 | 0 | 0 | 0 | 0 | Pass at 80% or more | 1150 | Poor | 12.3 | NC-A |
| Comparative Example 11 | 61.2 | 38.8 | 0 | 0 | 0 | 0 | 18.8 | Pass at 80% or more | 1063 | Poor | 9.6 | NC-A |
| Comparative Example 12 | 65.8 | 34.2 | 0 | 1.2 | 0 | 0 | 21.1 | 71% | 878 | Poor | Not evaluable | Not evaluable |
| Comparative Example 13 | 66.2 | 33.8 | 0 | 2.9 | 0 | 0 | 100 | 10% | 774 | Poor | Not evaluable | Not evaluable |
| Comparative Example 14 | 60.9 | 39.1 | 0 | 0.5 | 0 | 0 | 49 | 63% | 683 | Poor | Not evaluable | Not evaluable |
| Comparative Example 15 | 59.9 | 38.6 | 0 | 1.5 | 0 | 0 | 100 | 20% | 640 | Poor | Not evaluable | Not evaluable |
| Comparative | 59 | 38.1 | 0 | 2.9 | 0 | 0 | 100 | 20% | 829 | Poor | Not | Not |

TABLE 1-continued

| | Alloy composition (wt %) | | | | | | β Percentage | Cold | Extrusion pressure at 500° C. | Mean pull-out strength after exposure to | Mean crystal grain size of evaluated | Needle detection |
|---|---|---|---|---|---|---|---|---|---|---|---|---|
| | Cu | Zn | Mn | Al | Si | Sn | (%) | workability | (MPa) | ammonia | material (μm) | standard |
| Example 16 | | | | | | | | | | | evaluable | evaluable |
| Comparative Example 17 | 60.3 | 35.8 | 0 | 3.9 | 0 | 0 | 100 | 20% | 845 | Poor | Not evaluable | Not evaluable |
| Comparative Example 18 | 64.1 | 34.4 | 0 | 0 | 1.5 | 0 | 38 | 39% | 878 | Poor | Not evaluable | Not evaluable |
| Comparative Example 19 | 62.7 | 34.3 | 0 | 0 | 3 | 0 | 86 | 10% | 774 | Poor | Not evaluable | Not evaluable |
| Comparative Example 20 | 60.5 | 39.2 | 0 | 0 | 0.3 | 0 | 40.1 | 39% | 738 | Poor | Not evaluable | Not evaluable |
| Comparative Example 21 | 60.2 | 39.3 | 0 | 0 | 0.5 | 0 | 51.2 | 39% | 731 | Poor | Not evaluable | Not evaluable |
| Comparative Example 22 | 60.3 | 39.3 | 0 | 0 | 0.4 | 0 | 55.4 | 22% | 700 | Poor | Not evaluable | Not evaluable |
| Comparative Example 23 | 60.3 | 39 | 0 | 0 | 0.7 | 0 | 79.6 | 20% | 685 | Poor | Not evaluable | Not evaluable |
| Comparative Example 24 | 64.8 | 34.2 | 0 | 0 | 0 | 1.0 | 18 | 71% | 1016 | Poor | Not evaluable | Not evaluable |
| Comparative Example 25 | 64.3 | 33.7 | 0 | 0 | 0 | 2.0 | 12 | 35% | 925 | Poor | Not evaluable | Not evaluable |
| Comparative Example 26 | 60.4 | 38.6 | 0 | 0 | 0 | 1.0 | 44.8 | 63% | 783 | Poor | Not evaluable | Not evaluable |
| Comparative Example 27 | 59.7 | 38.3 | 0 | 0 | 0 | 2.0 | 43.4 | 27% | 726 | Poor | Not evaluable | Not evaluable |
| Comparative Example 28 | 59 | 37.9 | 0 | 0 | 0 | 3.1 | 45.1 | 10% or less | 656 | Poor | Not evaluable | Not evaluable |
| Comparative Example 29 | 60.4 | 37.5 | 2.1 | 0 | 0 | 0.0 | 40.5 | 71% | 924 | Poor | Not evaluable | Not evaluable |

All of Examples 1-9 exhibited excellent cold-workability of 80% or more and extrusion surface pressure of 850-1100 N at 500° C. Pull-out strengths after ammonia vapor test for all of Examples 1-9 are also "excellent" or "Good," and these results show that copper alloys excellent in season cracking resistance and cold workability were obtained.

Comparative Example 1 is excellent in cold-workability and season cracking resistance but has a low zinc concentration, thereby increasing the material cost. In addition, Comparative Example 1 exhibited a high extrusion surface pressure at 500° C., and therefore production using extrusion is difficult.

All of Comparative Examples 2-6 and 11, which are examples added with no Mn as an additional element, exhibited low pull-out strength after ammonia vapor test, thereby being inferior in season cracking resistance.

Comparative Examples 7 and 8 exhibited a draft limit of only about 39% and are inferior in cold workability due to the β-phase percentage as high as 40%. In addition, both of Comparative Examples 7 and 8 did not exhibit high cold-workability comparable to that for Examples 1-9 but exhibited too low cold-workability to make the test pieces for ammonia vapor test, and the test pieces could not be made in a state of having residual stress after cold working, thereby failing in evaluation of the crystal grain size.

Both of Comparative Examples 9 and 10 do not have structure of the mixed phase of α+β phase and also are inferior in season cracking resistance in spite of addition of Mn as an additional element.

Comparative Examples 12-17 show examples added with Al as an additional element. All of Comparative Examples 12-17 did not exhibit high cold-workability comparable to that for Examples 1-9 but exhibited too low cold-workability to make the test pieces for ammonia vapor test, and the test pieces could not be made in a state of having residual stress after cold working.

Comparative Examples 18-23 are examples added with Si as an additional element and Comparative Examples 24-28 are examples added with Sn as an additional element. All of Comparative Examples 18-28 did not exhibit high cold-workability comparable to that for Examples 1-9 but exhibited too low cold-workability to make the test pieces for ammonia vapor test. Comparative Example 29 is an example which has a composition within the composition range of the present invention and a higher β-phase percentage. Similarly to the above, Comparative Example 29 did not exhibit high cold-workability comparable to Examples but exhibited too low cold-workability to make the test pieces for ammonia vapor test.

DESCRIPTION OF REFERENCE NUMBERS

1 Slide fastener
2 Fastener stringer
3 Fastener tape
4 Element row
5 Top end stop
5*a* Flat rectangle
6 Bottom end stop
6*a* Deformed wire rod
7 Slider
10 Fastener element
10*a* Engaging head
10*b* Body part
10*c* Leg part
10*c* Leg parts
20 Y-bar (wire rod)
21 Element material
31 Extruder container
32 Billet
33 Stem
34 Die

The invention claimed is:

1. A slide fastener comprising at least one of a fastener element, a top end stop, a bottom end stop, and a slider, the slide fastener being made from a copper alloy wherein the alloy has a structure of a mixture of α-phase having a face centered cubic structure and a β-phase having a body centered cubic structure, wherein a β-phase percentage (%) in the structure is 22 or less as determined from observation of a cross section perpendicular to a rolled surface using an integrated peak intensity ration in X-ray diffraction, and wherein the alloy has a composition consisting of: $Cu_{bal.}Zn_aMn_b$ and inevitable impurities, where bal., a, and b are expressed in % by mass, bal. represents the balance and is greater than 50, $35 \leq a \leq 38.3$, $0.1 \leq b \leq 0.9$; and the composition satisfying the following equations (3) and (4):

$$b \geq -a+38.5, \text{ where } 35 \leq a \leq 38.3 \quad (3),$$

$$b \leq -a+40.5, \text{ where } 37 \leq a \leq 38.3 \quad (4).$$

2. The copper alloy for a slide fastener according to claim 1, wherein the β-phase percentage in the structure is greater than or equal to 0.1.

3. The copper alloy for a slide fastener according to claim 1, wherein a mean crystal grain size in the structure is 3-14 μm.

4. The copper alloy for a slide fastener according to claim 2, wherein a mean crystal grain size in the structure is 3-14 μm.

5. The copper alloy for a slide fastener according to claim 1, wherein a pull-out strength after ammonia vapor test is 70% or more relative to that of $Cu_{85}Zn_{15}$ material.

6. A component article for fastening formed of a copper alloy, wherein the copper alloy has a structure of a mixture of α-phase having a face centered cubic structure and a β-phase having a body centered cubic structure, wherein a β-phase percentage (%) in the structure is 22 or less as determined from observation of a cross section perpendicular to a rolled surface using an integrated peak intensity ration in X-ray diffraction, and wherein the alloy has a composition consisting of: $Cu_{bal.}Zn_aMn_b$ and inevitable impurities, where bal., a, and b are expressed in % by mass, bal. represents the balance and is greater than 50, $35 \leq a \leq 38.3$, $0.1 \leq b \leq 0.9$; and the composition satisfies the following equations (3) and (4):

$$b \geq -a+38.5, \text{ where } 35 \leq a \leq 38.3 \quad (3),$$

$$b \leq -a+40.5, \text{ where } 37 \leq a \leq 38.3 \quad (4).$$

7. The copper alloy for a slide fastener according to claim 1, wherein the alloy has a cold workability of 80% or more.

* * * * *